US007279837B2

(12) United States Patent
Kwon et al.

(10) Patent No.: US 7,279,837 B2
(45) Date of Patent: Oct. 9, 2007

(54) PLASMA DISPLAY PANEL COMPRISING DISCHARGE ELECTRODES DISPOSED WITHIN OPAQUE UPPER BARRIER RIBS

(75) Inventors: Jae-Ik Kwon, Asan-si (KR); Kyoung-Doo Kang, Seoul (KR); Won-Ju Yi, Asan-si (KR); Jeong-Chull Ahn, Cheonan-si (KR); Eun-Young Jung, Yongin-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/033,518

(22) Filed: Jan. 12, 2005

(65) Prior Publication Data

US 2005/0212423 A1 Sep. 29, 2005

(30) Foreign Application Priority Data

Mar. 24, 2004 (KR) ..... 10-2004-0019982
Mar. 29, 2004 (KR) ..... 10-2004-0021151

(51) Int. Cl.
*H01J 17/49* (2006.01)

(52) U.S. Cl. ..... 313/583; 313/587; 313/582

(58) Field of Classification Search ..... 313/582–587
See application file for complete search history.

(56) References Cited

U.S. PATENT DOCUMENTS 5,371,437 A * 12/1994 Amano ..... 315/169.1

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Mariceli Santiago
(74) *Attorney, Agent, or Firm*—Robert E. Bushnell, Esq.

(57) ABSTRACT

The present invention provides a plasma display panel (PDP) with a structure that can reduce an outer reflection of an external light source and increase the reflection of visible rays emitted from the phosphor, remarkably increase the aperture ratio of the front panel, and remarkably reduce occurrence of a permanent residual image. The PDP includes: a transparent front panel; a rear panel disposed in parallel with the front panel; a plurality of opaque upper barrier ribs disposed between the front panel and the rear panel to define a plurality of discharge cells, and formed of a dielectric material; a lower discharge electrode and an upper discharge electrode disposed within the plurality of opaque upper barrier ribs so as to enclose the discharge cells; a plurality of lower barrier ribs disposed between the plurality of opaque upper barrier ribs and the rear panel; a phosphor layer disposed within a space defined by the plurality of lower barrier ribs; and a discharge gas disposed inside the discharge cells.

23 Claims, 7 Drawing Sheets

U.S. PATENT DOCUMENTS

| | | | | |
|---|---|---|---|---|
| 5,541,618 | A | 7/1996 | Shinoda | 345/60 |
| 5,661,500 | A | 8/1997 | Shinoda et al. | 345/60 |
| 5,663,741 | A | 9/1997 | Kanazawa | 345/66 |
| 5,674,553 | A | 10/1997 | Sinoda et al. | 427/68 |
| 5,701,056 | A * | 12/1997 | Shinohara | 313/584 |
| 5,724,054 | A | 3/1998 | Shinoda | 345/60 |
| 5,744,909 | A * | 4/1998 | Amano | 313/585 |
| 5,786,794 | A | 7/1998 | Kishi et al. | 345/60 |
| 5,952,782 | A | 9/1999 | Nanto | 313/584 |
| RE37,444 | E | 11/2001 | Kanazawa | 345/67 |
| 6,630,916 | B1 | 10/2003 | Shinoda | 345/60 |
| 6,707,436 | B2 | 3/2004 | Setoguchi et al. | 345/60 |
| 6,833,673 | B2 * | 12/2004 | Toyoda et al. | 313/583 |
| 6,903,711 | B2 * | 6/2005 | Akiba | 345/67 |
| 2004/0245929 | A1 * | 12/2004 | Sakamoto | 313/584 |
| 2005/0236986 | A1 | 10/2005 | Kwon et al. | |

FOREIGN PATENT DOCUMENTS

| | | |
|---|---|---|
| JP | 08-045433 | 2/1996 |
| JP | 2845183 | 10/1998 |
| JP | 2917279 | 4/1999 |
| JP | 2001-043804 | 2/2001 |
| JP | 2001-325888 | 11/2001 |
| KR | 10-2001-0093033 | 10/2001 |

OTHER PUBLICATIONS

Korean Office Action of the Korean Patent Application No. 2004-21151, issued on Apr. 26, 2006.

* cited by examiner

PLASMA DISPLAY PANEL COMPRISING DISCHARGE ELECTRODES DISPOSED WITHIN OPAQUE UPPER BARRIER RIBS

CLAIM OF PRIORITY

This application makes reference to, incorporates the same herein, and claims all benefits accruing under 35 U.S.C. §119 from applications for PLASMA DISPLAY PANEL earlier filed in the Korean Intellectual Property Office on the 24 Mar. 2004 and there duly assigned Serial No. 2004-19982, and for PLASMA DISPLAY PANEL earlier filed in the Korean Intellectual Property Office on the 29 Mar. 2004 and there duly assigned Serial No. 2004-21151.

BACKGROUND OF THE INVENTION

1. Field of the Invention

The present invention relates to a Plasma Display Panel (PDP), and more particularly, to a PDP that forms an image by applying a discharge voltage to a plurality of electrodes arranged on two panels facing each other to generate ultraviolet rays which excite phosphor layers.

2. Description of the Related Art

Recently, a flat panel display employing a plasma display panel (PDP) has been in the spotlight as a next generation display owing to superior characteristics such as a large-sized screen, a high picture quality, a slim profile and a wide viewing angle, a simple fabrication method, and it being easy to make a large-sized screen compared with other flat displays.

The PDP may be classified into a DC (direct current) type PDP, an AC (alternating current) type PDP, and a hybrid type PDP according to a discharge voltage applied to the panel, and also be classified into a facing discharge type PDP and a surface discharge type PDP according to a discharge structure.

The DC type PDP has a structure in which all electrodes are exposed to a discharge space and charges move directly between the electrodes. The AC type PDP has a structure in which at least one electrode is covered with a dielectric layer, and charges do not move directly between the corresponding electrodes but discharge is performed by wall charges.

The DC type PDP has a drawback in that the electrodes are seriously damaged because charges are directly moved between corresponding electrodes. To this end, the AC type PDP, especially, an AC type PDP having a three-electrode surface discharge structure has been generally employed.

Referring to FIG. 1, a conventional surface discharge type PDP 10 with such an AC type three-electrode surface discharge structure includes a front panel 20 and a rear panel 30.

Address electrodes 33 generating an address discharge, a rear dielectric layer 35 covering the address electrodes 33, barrier ribs 37 partitioning discharge cells, and a phosphor layer 39 formed on both sidewalls of each of the barrier ribs 37 and on the rear dielectric layer 35 on which the barrier ribs 37 are not formed are arranged on the rear panel 30.

The front panel 20 is spaced apart from and facing the rear panel 30. Moreover, common electrodes 22, scan electrodes 23, a front dielectric layer 25 covering the common electrodes 22 and the scan electrodes 23, and a passivation layer 29 covering the front dielectric layer 25 are arranged on the front panel.

The common electrodes 22 disposed on the front panel 20 through which visible rays generated from the phosphor layer 39 of a discharge space pass, have a transparent common electrode 22*a* and a bus common electrode 22*b* disposed at one edge of the transparent common electrode 22*a*, the scan electrodes 23 have a transparent scan electrode 23*a* and a bus scan electrode 23*b* disposed at one edge of the transparent scan electrode 23*a*, and the front dielectric layer 25 and the passivation layer 29 covering the front dielectric layer 25 are sequentially formed on the common electrodes 22 and the scan electrodes 23. Due to the aforementioned elements, only 60% of the visible rays can pass through the front panel 20, which serves as an important factor.

Also, the conventional surface discharge PDP 10 has a drawback that the luminous efficiency is low because electrodes generating a discharge are arranged on an upper surface of the discharge space, i.e., on an inner surface of the front panel 20 through which the visible rays pass so that the discharge is generated in the inner surface of the front panel 20.

Further, the conventional surface discharge PDP 10 may cause a permanent residual image because when the conventional surface discharge PDP 10 is used for a long time, charged particles of discharge gases generate ion sputtering in the phosphor due to an applied electric field.

Furthermore, the front dielectric layer formed on the front panel 20 should be transparent, such that the visible rays excited from the phosphor layer pass therethrough. Due to the transparent front dielectric layer, external light that is incident into the PDP is reflected by the transparent front dielectric layer and then emitted to an exterior. As a result, the conventional surface discharge PDP 10 has a drawback that a contrast ratio is not high.

To improve the above drawbacks, a black stripe is disposed on non-discharge regions, or a line width of the bus electrode is increased, thereby more or less increasing the contrast ratio. However, since the size of the non-discharge area is limited so as to maintain the aperture ratio above a predetermined value, there is a limitation in disposing the black stripe or increasing the line width of the bus electrode.

SUMMARY OF THE INVENTION

It is therefore, an object of the present invention to provide a plasma display panel (PDP) that can remarkably increase the aperture ratio and transmittance, compared with the conventional PDP and also remarkably extend a discharge area.

It is also another object of the present invention to provide a PDP that can efficiently use space charges of plasma by concentrating discharge plasma on a predetermined region of discharge space, for example, on a middle portion, operate at a low voltage, and remarkably reduce the permanent residual image phenomenon by substantially improving the luminous efficiency.

It is a further object of the present invention to provide a PDP with a structure that can reduce an outer reflection of an external light source and increase the reflection of visible rays emitted from the phosphor.

It is yet another object to provide a PDP through upper barrier ribs preventing external light from being reflected, bright room contrast is increased and visible rays excited from the phosphor layer are reflected so that brightness and color purity are enhanced, resulting in an increase in light efficiency.

It is a further object to provide a PDP through the structure of the PDP being much improved and the amount of plasma being greatly increased, much visible rays are emitted, brightness is increased, and a low voltage operation is possible, thereby increasing the luminous efficiency.

According to an aspect of the present invention, there is provided a PDP including: a transparent front panel, a rear panel, a plurality of opaque upper barrier ribs, a lower discharge electrode and an upper discharge electrode, a plurality of lower barrier ribs, a phosphor layer, and a discharge gas.

The rear panel is disposed in parallel with the front panel. The plurality of opaque upper barrier ribs are disposed between the front panel and the rear panel to define a plurality of discharge cells, and formed of a dielectric material. The lower discharge electrode and upper discharge electrode are disposed within the plurality of opaque upper barrier ribs so as to enclose the discharge cells. The plurality of lower barrier ribs are disposed between the plurality of opaque upper barrier ribs and the rear panel. The phosphor layer is disposed within a space defined by the plurality of lower barrier ribs. The discharge gas is disposed inside the discharge cells.

The plurality of opaque upper barrier ribs may take on a dark color.

The above plasma display panel may further include at least one floating electrode disposed within the plurality of opaque upper barrier ribs so as to enclose the discharge cells, or extending in one direction within the front panel.

According to another aspect of the present invention, there is provided a plasma display panel including: a transparent front panel, a rear panel, a plurality of upper barrier ribs, an upper discharge electrode, a lower discharge electrode, a plurality of lower barrier ribs, a phosphor layer, and a discharge gas.

The rear panel is disposed in parallel with the front panel. The plurality of upper barrier ribs include a plurality of first dark-colored upper barrier ribs disposed between the front panel and the rear panel to define a plurality of discharge cells and formed of a dielectric material, and a plurality of second upper barrier ribs stacked on lower surfaces of the plurality of first upper barrier ribs, formed of a dielectric material, and having a higher light reflectivity than the first upper barrier ribs. The lower discharge electrode and upper discharge electrode are disposed within the plurality of upper barrier ribs so as to enclose the discharge cells. The plurality of lower barrier ribs are disposed between the plurality of upper barrier ribs and the rear panel. The phosphor layer is disposed within a space defined by the plurality of lower barrier ribs. The discharge gas is disposed inside the discharge cells.

The second upper barrier ribs may take on a bright color.

At this time, the first upper barrier ribs may take on a dark color.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
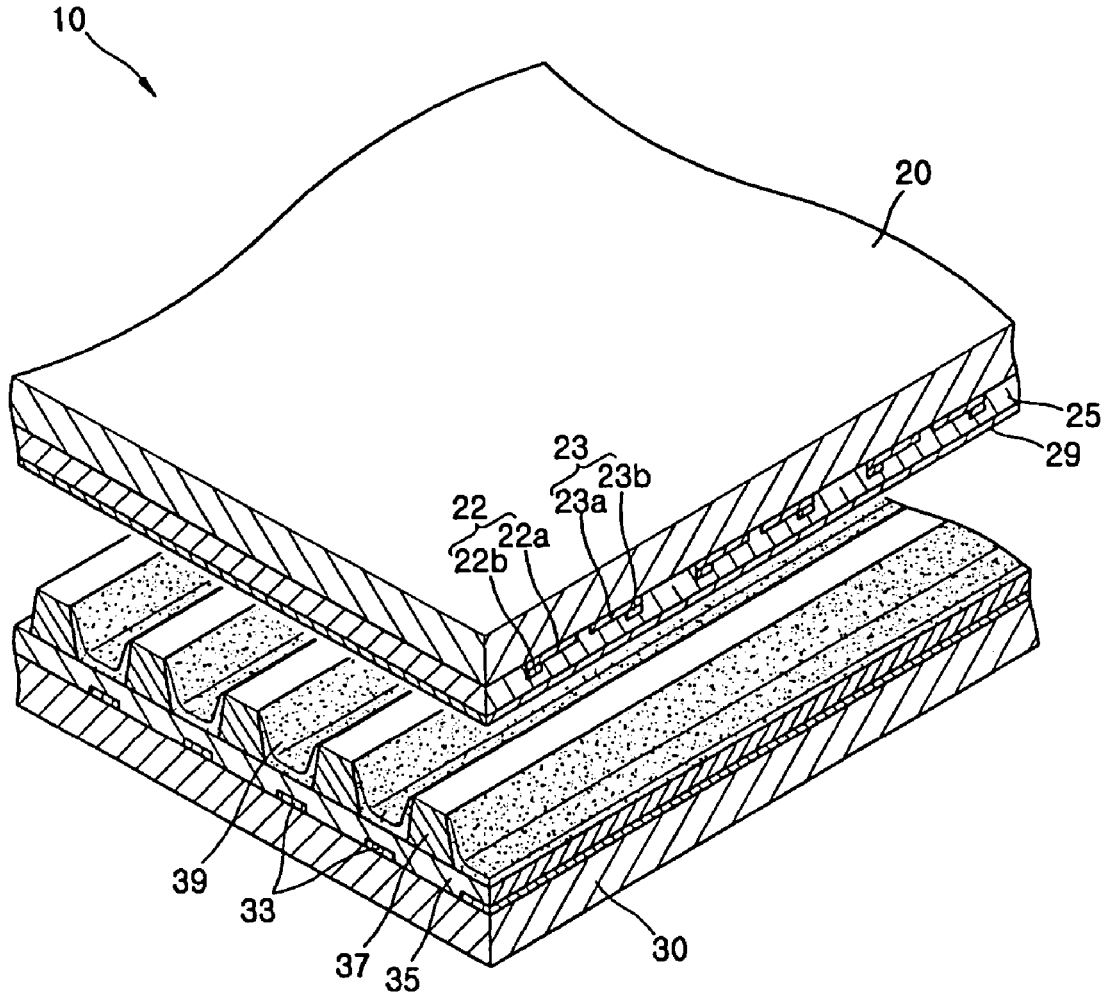
FIG. 1 (CONVENTIONAL ART)
FIG. 1 is an exploded perspective view of a conventional PDP.

The present invention will now be described more fully with reference to the accompanying drawings, in which exemplary embodiments of the invention are shown.

A Plasma Display Panel (PDP) according to a first embodiment of the present invention will now be described in detail with reference to FIGS. 2 through 4.

A PDP 100 according to a first embodiment of the present invention includes an upper panel (front panel) 120, a lower panel (rear panel) 130, upper barrier ribs 127, upper discharge electrodes 122, lower discharge electrodes 123, lower barrier ribs 137, phosphor layers 139, and a discharge gas (not shown).

The front panel 120 is transparent so that a visible ray is transmitted to project an image. The front panel 120 is arranged in parallel with the rear panel 130. The upper barrier ribs 127 are formed between the front panel 120 and the rear panel 130. The upper barrier ribs 127 are arranged at a non-discharge region to partition discharge cells. The upper discharge electrodes 122 and the lower discharge electrodes 123 are formed within the upper barrier ribs 127 to enclose the discharge cells. In this case, the upper discharge electrode 122 means an electrode arranged at an upper portion of the lower discharge electrode 123.

The lower barrier ribs 137 are formed between the upper barrier ribs 127 and the rear panel 130. The upper barrier ribs 127 prevent cross talk between charged particles. The phosphor layers 139 are disposed in spaces defined by the lower barrier ribs 137. The discharge gas is filled within the discharge cells.

The upper discharge electrodes 122 and the lower discharge electrodes 123 may be formed crossing with one another. In this case, one of the upper discharge electrodes 122 and the lower discharge electrodes 123 acts as an address electrode and the other acts as a discharge electrode to generate a discharge.

Figure 2:
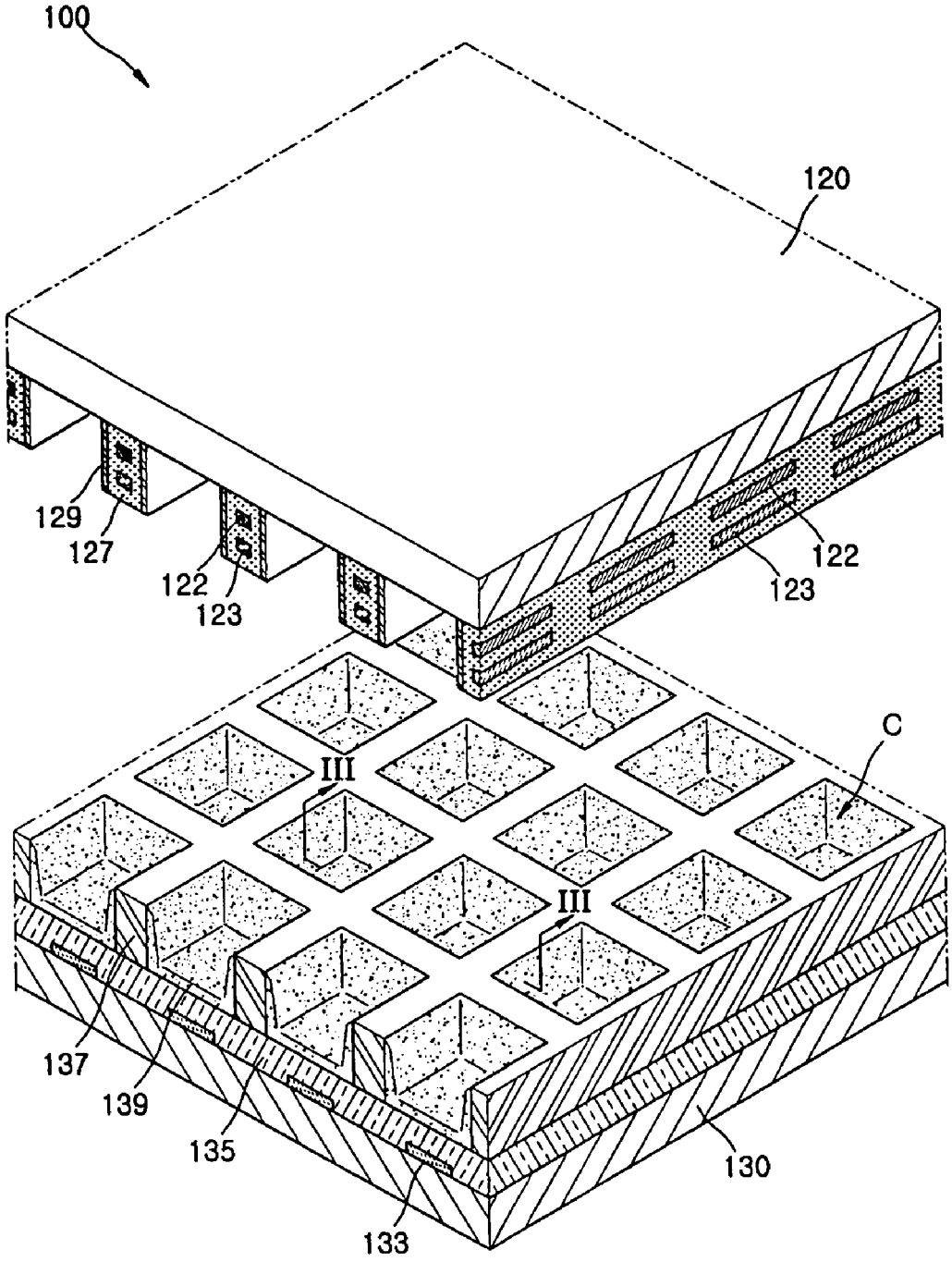
FIG. 2 is an exploded perspective view of a PDP according to a first embodiment of the present invention.
Figure 3:
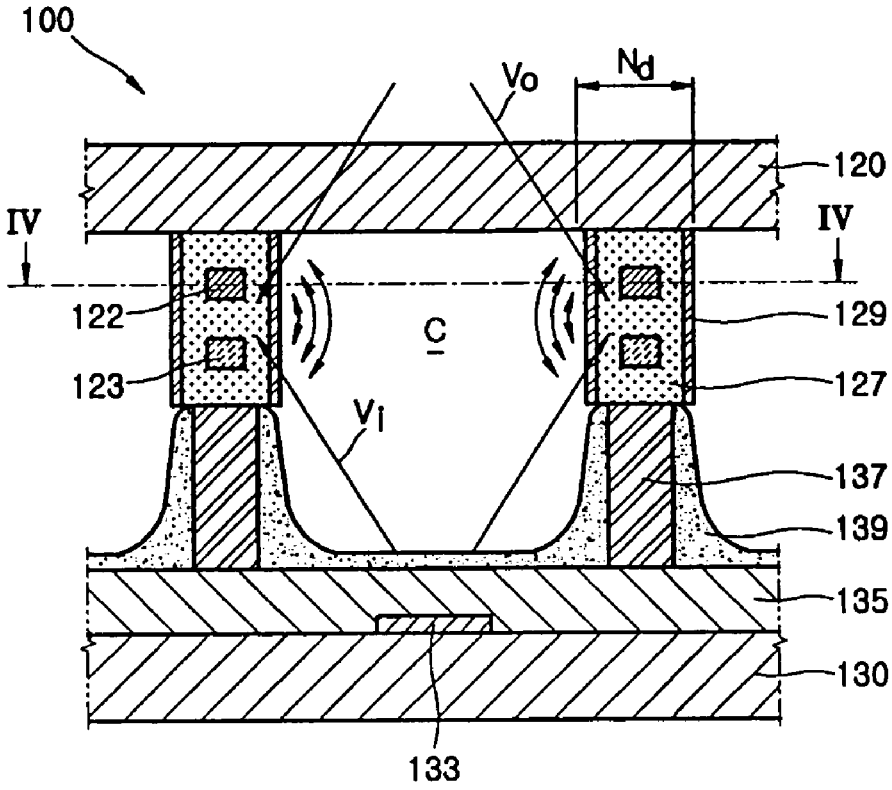
FIG. 3 is a sectional view taken along the line III-III of FIG. 2.
Figure 4:
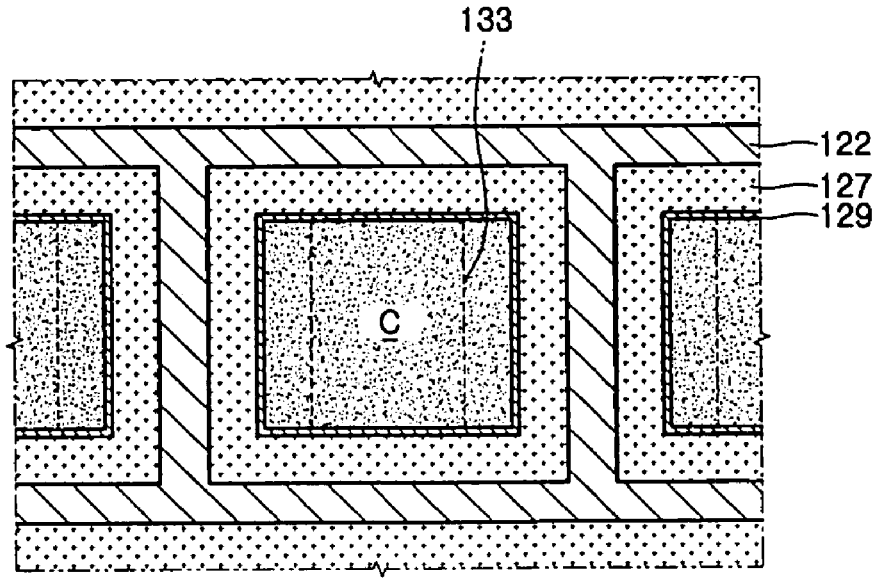
FIG. 4 is a sectional view taken along the line IV-IV of FIG. 3.

Also, as shown in FIGS. 2 and 3, the upper discharge electrodes 122 and the lower discharge electrodes 123 may be arranged extending in one direction in parallel with one another and the PDP may further include address electrodes 133 extending to cross the upper discharge electrodes 122 and the lower discharge electrodes 123. In this case, it is preferable that sides of the address electrodes 133 are covered by protective layer 129, the address electrodes 133 are arranged between the rear panel 130 and the phosphor layers 139, and a dielectric layer 135 is formed between the address electrodes 133 and the phosphor layers 139.

In more detail, the PDP includes: the rear panel 130; the address electrodes 133 disposed on the rear panel 130 and extending in one direction; the dielectric layer 135 covering the address electrodes; the lower barrier ribs 137 formed on the dielectric layer 135 to partition the discharge cells C; the lower discharge electrodes 123 enclosing the upper portions of the discharge cells C and extending to cross with the address electrodes; the upper discharge electrodes 122 enclosing the upper portions of the discharge cells C and extending in parallel with the scanning electrodes; the upper barrier ribs 127 covering the upper discharge electrodes 122 and the lower discharge electrodes 123; the phosphor layers 139 formed on sides of the barrier ribs and on the dielectric layer on which the barrier ribs are not formed; the discharge gas filled within the discharge cells; and the front panel 120 disposed on the upper barrier ribs 127 in parallel with the rear panel 130.

The rear panel 130 supports the address electrodes 133 and the dielectric layer 135 and it is usually formed of a material whose main component is a glass.

The address electrodes 133 generate an address discharge so as to make it easy to generate a sustain discharge between the lower discharge electrode 123 and the upper discharge electrode 122. Specifically, the address electrodes 133 function to lower a voltage at which the sustain discharge is initiated.

When the address electrodes 133 are formed on the rear panel 130, the upper discharge electrode 122 and the lower discharge electrode 123 may be the scan electrode and the common electrode, respectively. However, it is more preferable that the upper discharge electrode 122 and the lower discharge electrode 133 are the common electrode and the scanning electrode, respectively. This is because a discharge pass between the scanning electrode and the address electrode 133 is shortened so that the address discharge is smoothly generated. Therefore, for convenience's sake, it is assumed that the upper discharge electrode 122 and the lower discharge electrode 123 act as the common electrode and the scanning electrode, respectively.

In this embodiment, the lower discharge electrode 123 and the upper discharge electrode 122 are arranged to enclose the upper portion of the discharge cell C. The upper portion of the discharge cell C means a portion higher than the lower barrier rib 137.

The lower discharge electrode 123 and the upper discharge electrode 122 may be arranged crossing with each other. However, when the address electrode 133 is formed on the rear panel, it is preferable that the lower discharge electrode 123 and the upper discharge electrode 122 are arranged in parallel.

Also, although each of the lower discharge electrodes 123 and the upper discharge electrodes 122 is arranged with one electrode in FIG. 2, it may be formed with two or more sub electrodes.

The address discharge is generated between the lower discharge electrode 123 and the address electrode 133. If the address discharge is ended, positive ions are accumulated in the lower discharge electrode 123 and electrons are accumulated in the upper discharge electrode 122. Thus, the sustain discharge is more easily generated between the upper discharge electrode 122 and the lower discharge electrode 123.

The dielectric layer 135 is formed of a dielectric material that can prevent the address electrode from being damaged when the positive ions or electrons are collided with the address electrode 133 during the discharge and can also induce charges. PbO, $B_2O_3$ or $SiO_2$ is used as the dielectric material.

The lower barrier ribs 137 prevent an incorrect discharge from occurring between the discharge cells corresponding to one subpixel among a red discharge subpixel, a green discharge subpixel and a blue discharge subpixel. Although the discharge cells C of the lower barrier ribs 137 are partitioned in a matrix shape in FIG. 2, the present invention is not limited to it. That is, the discharge cells C can be partitioned in various shapes, such as a honeycomb shape. Also, although the cross-section of the discharge cell C defined by the lower barrier rib 137 is a quadrangular shape in FIG. 2, it can also be formed in a polygonal shape, such as a triangle and a pentagon, or a circular shape or an elliptic shape.

If the PDP 100 of the present invention includes the address electrodes 133, the lower discharge electrodes 123 and the upper discharge electrodes 122 are electrodes for the sustain discharge. The sustain discharge for implementing the images on the PDP is generated between the lower discharge electrodes 123 and the upper discharge electrodes 122. The lower discharge electrodes 123 and the upper discharge electrodes 122 are formed of conductive materials, such as aluminum and copper.

At this point, the address electrodes 133 extend crossing with the upper discharge electrodes 122 and the lower discharge electrodes 123. In this case, it is preferable that the upper discharge electrodes 122 extend in parallel with the lower discharge electrodes 123. That the lower discharge electrodes 123 extend crossing with the address electrodes 133 means that columns of the discharge cells C passing the address electrodes are crossed with columns of the discharge cells C passing the lower discharge electrodes 123. Also, that the upper discharge electrodes 122 extend in parallel with the lower discharge electrodes 123 means that the upper discharge electrodes are disposed spaced apart from the lower discharge electrodes by a predetermined distance.

The upper barrier ribs 127 partition the adjacent discharge cells C and are formed of the dielectric material so that the lower discharge electrodes 123 and the upper discharge electrodes 122 are prevented from being directly conductive during the sustain discharge. Also, the upper barrier ribs 127 prevent the electrodes 122 and 123 from being damaged when the charged particles are directly collided with the electrodes, and they guide the charged particles to accumulate the wall charges.

The upper barrier ribs 127 are arranged at non-discharge region Nd, which corresponds to a region between the adjacent discharge cells C as seen for example in FIG. 3. Thus, the visible rays Vi excited at the phosphor layer are not required to pass through the upper barrier ribs 127 so as to implement the image. That is, the upper barrier ribs 127 need not be transparent.

Further, if the upper barrier ribs 127 are transparent, the visible rays Vi pass through the upper barrier ribs 127 which partition the adjacent discharge cells C, such that the visible rays Vi leak toward the adjacent discharge cells. Consequently, picture quality and color reproduction are degraded and a contrast ratio decreases because external rays Vo incident to the panel are reflected from the upper barrier ribs 127.

Accordingly, in this embodiment, the upper barrier ribs 127 are formed opaquely.

In this case, it is preferable that the upper barrier ribs 127 take on a dark color. The reason for this is because the dark color absorbs the light well. That is, if the upper barrier ribs 127 take on the dark color, the incident external rays Vo having passed through the front panel 120 are absorbed by the upper barrier ribs 127, so that the incident external rays Vo are not reflected. Thus, the nominal contrast ratio increases remarkably. Here, the dark color means a color having brightness of less than four in a Munsell color system.

The upper barrier ribs 127 may include a dark-colored pigment in dielectric materials whose main component is PbO, $B_2O_3$ or $SiO_2$. That is, the upper barrier ribs 127 can take on the opaque dark color by adding the dark-colored pigment to the components of the front dielectric layer adopted in the conventional PDP.

In this case, the pigment component may be one selected from the group including CdSe, CdS, CoO, $Al_2O_3$, ZnO, $Fe_2O_3$, $Cr_2O_3$, $Cr_2O_3$, $MnO_2$, CuO, and NiO.

It is preferable that the upper barrier ribs 127 are covered with the protective layer 129. Although a layer that is generally formed of MgO is not a required component, it can prevent the upper barrier ribs from being damaged when the charged particles are collided with the upper barrier ribs 127 and can emit a lot of secondary electrons during the discharge. Therefore, it is preferable that the PDP includes the protective layer. The protective layer 129 may be arranged only at the sides of the upper barrier ribs 127. However, for the sake of convenience in manufacture, the protective layer 129 can be simultaneously deposited on the sides of the upper barrier ribs 127 and a lower surface of the front panel 120 in which the upper barrier ribs 127 are not formed.

The phosphor layer 139 includes a component which receives ultraviolet rays emitted by the sustain discharge and irradiates visible rays. The phosphor layer formed at the red discharge subpixel includes a phosphor such as $Y(V, P)O_4$:Eu, and the phosphor layer formed at the green discharge subpixel includes a phosphor such as $Zn_2SiO_4$:Mn and $YBO_3$:Tb. Also, the phosphor layer arranged at the blue discharge subpixel includes a phosphor such as BAM:Eu.

The discharge gas filled within the discharge cells is, for example, an Ne—Xe mixed gas containing Xe as a main discharge gas. If necessary, a predetermined amount of Ne may be replaced with He.

The front panel 120 is formed of a material, such as a glass, which has a good light transmittance. Unlike the front panel of the conventional PDP shown in FIG. 1, the front panel 120 of the present invention does not include the transparent scan electrode 23*a* and the transparent common electrode 22*a* formed of the ITO (Indium tin oxide) layer, the bus common electrodes 22*b* and 23*b* formed of the material, the front dielectric layer 25 covering the electrodes 22*a*, 22*b*, 23*a* and 23*b*, and the passivation layer 29. Thus, the front transmittance of the visible rays is remarkably improved up to about 60-90% compared with the prior art. Therefore, when the images are reproduced at the brightness of the conventional level, the electrodes 122 and 123 are driven at a relatively low voltage, thereby improving the luminous efficiency.

In this case, since the upper discharge electrode 122 and the lower discharge electrode 123 are arranged not at the front panel 120 through which the visible rays pass, but at the sides of the discharge spaces, an electrode (e.g., a metal electrode) with small resistance instead of a transparent electrode with large resistance can be used as the discharge electrode. Consequently, it is possible to obtain a fast discharge response time and drive the PDP at a low voltage without any distortion of waveform.

Figure 5:
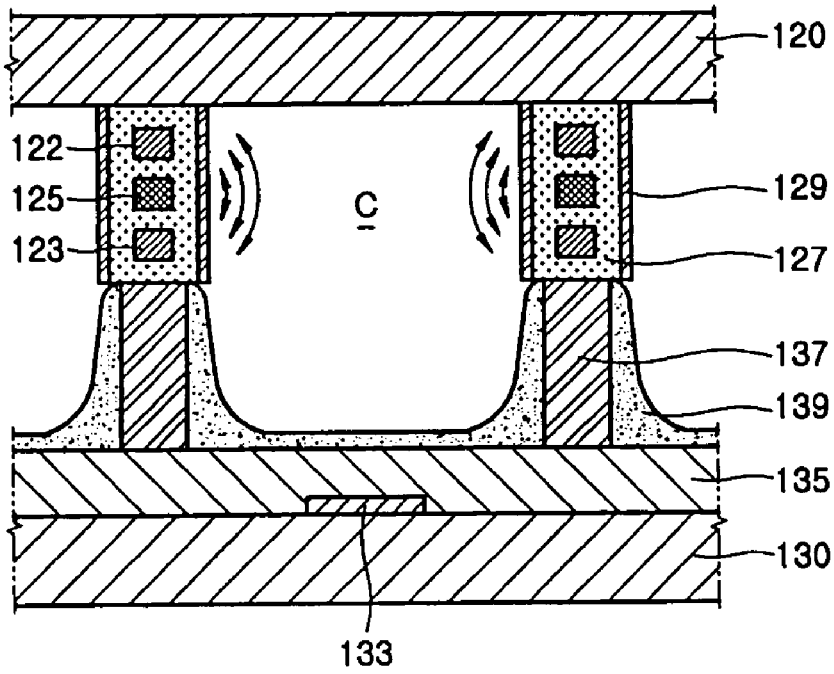
FIG. 5 is a first modification of FIG. 3.
Figure 6:
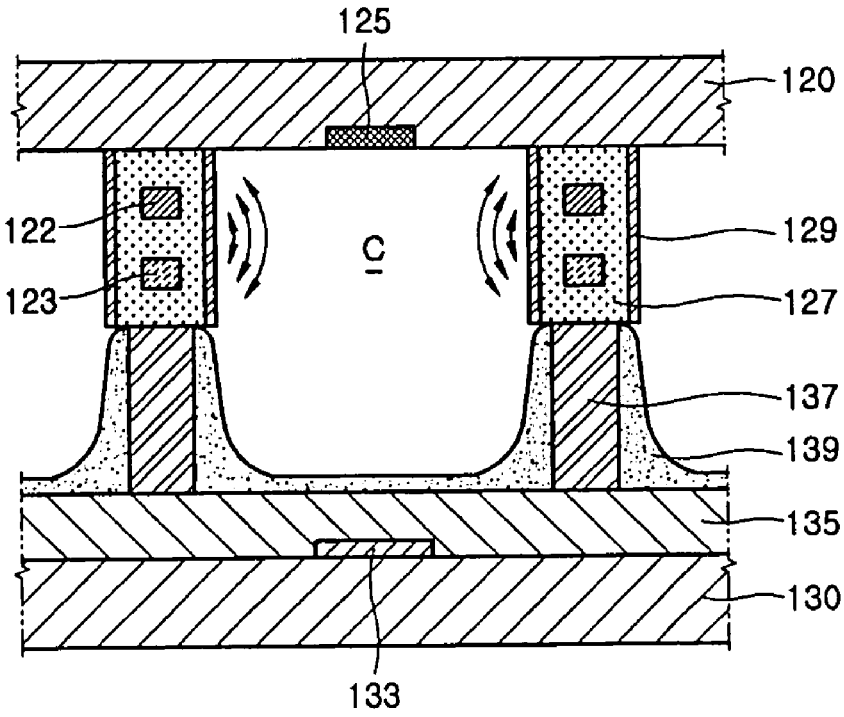
FIG. 6 is a second modification of FIG. 3.

Referring to FIGS. 5 and 6, the PDP 100 according to the first embodiment of the present invention may further include a floating electrode 125. The floating electrode 125 is not coupled to a separate active voltage source and it is formed of a material having a high electrical conductivity.

In this case, as shown in FIG. 5, the floating electrode 125 may extend in parallel with the upper discharge electrode 122 and the lower discharge electrode 123 therebetween. However, the position of the floating electrode 125 is not limited to it. That is, the floating electrode 125 can be formed at any position enclosing the discharge cells C. Also, although FIG. 5 shows that one floating electrode 125 is formed, a plurality of floating electrodes 125 can be applied.

Referring to FIG. 6, the floating electrode 125 can also be arranged in one direction within the front panel 120. In this embodiment, the discharge is generated at the upper barrier ribs 127 at which the upper and lower discharge electrodes 122 and 123 are disposed. Thus, a discharge area is expanded so that a discharge efficiency is improved and a discharge voltage decreases. However, it is preferable that the floating electrode 125 disposed at the front panel 120 is formed of a transparent electrode, such as ITO, because the visible rays due to the discharge is transmitted through the front panel 120.

In this embodiment, the address discharge is generated by applying the address voltage to the address electrode 133 and the lower discharge electrode 123. Then, the discharge cells C to generate the sustain discharge are selected.

Thereafter, when an AC sustain discharge voltage is applied between the lower discharge electrode 123 and the upper discharge electrode 122, the sustain discharge occurs between the lower discharge electrode 123 and the upper discharge electrode 122. If the floating electrode 125 is arranged, the floating electrode 125 has a potential between a potential of the upper discharge electrode 122 and a potential of the lower discharge electrode 123, and the sustain discharge is generated together with the upper and lower discharge electrodes 122 and 123.

Ultraviolet rays are emitted while an energy level of the discharge gas excited due to the sustain discharge is lowered. Then, the ultraviolet rays excite the phosphor layer 139 deposited within the discharge cells. While an energy level of the excited phosphor layer is lowered, visible rays are emitted, resulting in the implementation of the image.

In the case of the conventional PDP shown in FIG. 1, the sustain discharge between the scanning electrode 23 and the common electrode 22 is generated in a horizontal direction such that a discharge area is relatively narrow. However, in the case of the PDP according to the present invention, the sustain discharge is generated in a vertical direction at all sides defining the discharge cells C such that a discharge area is relatively wide.

Also, in this embodiment, the sustain discharge is first formed in a closed curve along the discharge cells C and then gradually diffused toward central portions of the discharge cells. Thus, a volume of an area where the sustain discharge is generated is increased. Further, space charges that are not used within the discharge cells in the prior art attribute to the luminescence. Consequently, the luminous efficiency of the PDP is improved.

In addition, in the discharge cells of the PDP according to the first embodiment of the present invention, the sustain discharge is generated only at the upper portions of the discharge cells, as shown in FIG. 3. Therefore, the ion sputtering of the phosphor due to the charged particles is prevented. Thus, even when the same images are displayed for a long time, a permanent residual image does not occur.

Further, even when the high concentration Xe gas is used as the discharge gas, the luminous efficiency can be improved. A low voltage driving is difficult when the high concentration Xe gas is used as the discharge gas so as to increase the luminous efficiency. However, as described above, the PDP and the flat display device having the same according to the present invention can achieve the low voltage driving. Therefore, even when the high concentration Xe gas is used as the discharge gas, the low voltage driving is possible so that the luminous efficiency is improved.

Figure 7:
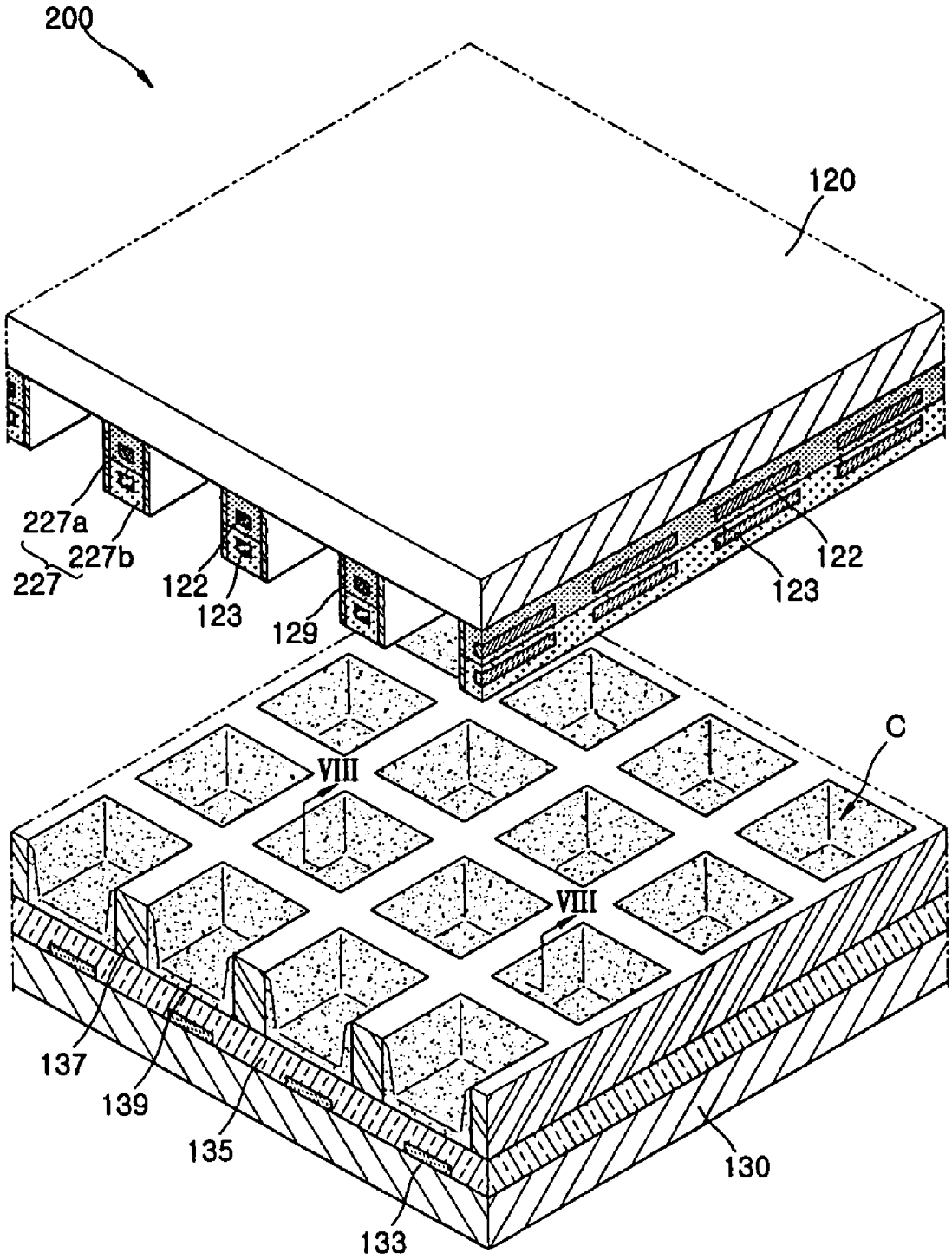
FIG. 7 is an exploded perspective view of a PDP according to a second embodiment of the present invention.
Figure 8:
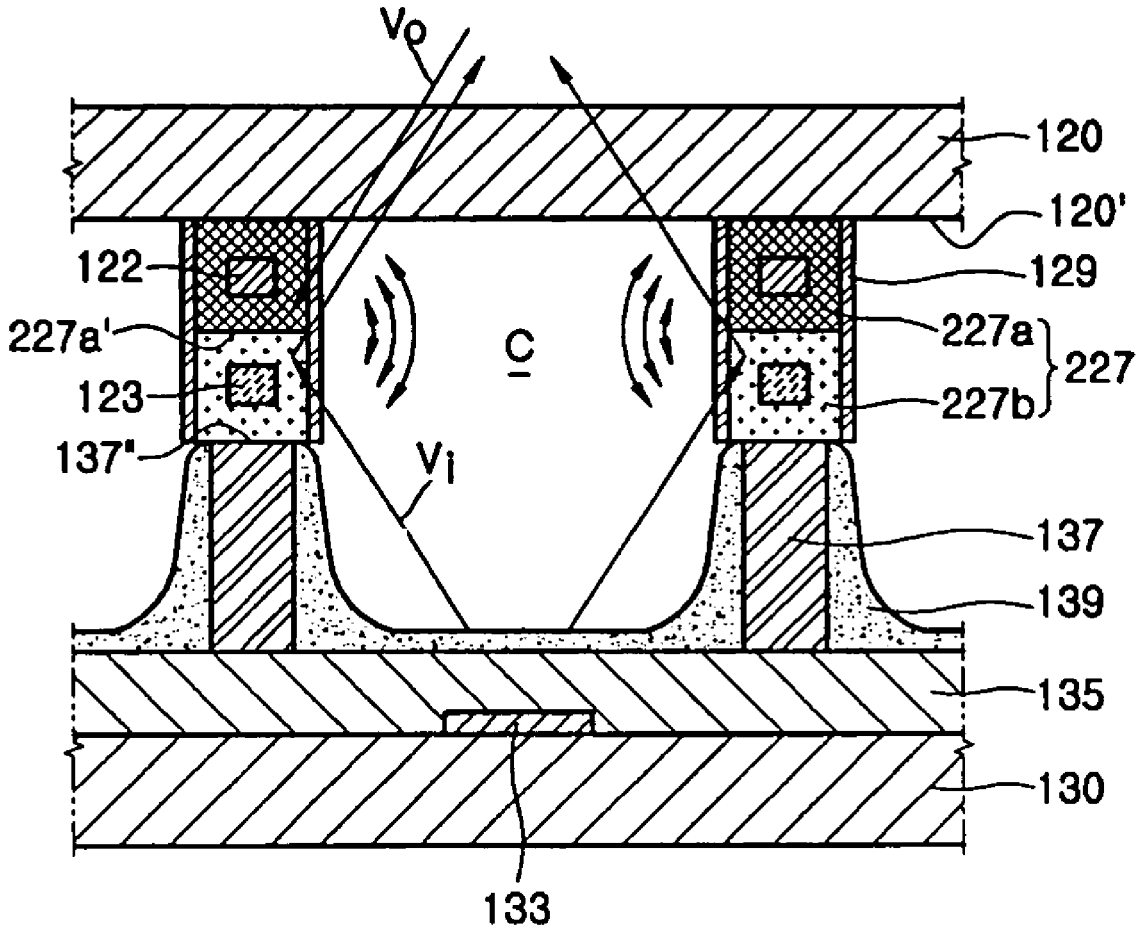
FIG. 8 is a sectional view taken along the line VIII-VIII of FIG. 7.

FIG. 7 is a perspective view of a PDP according to a second embodiment of the present invention, and FIG. 8 is a sectional view taken along line VIII-VIII of FIG. 7. Referring to FIGS. 7 and 8, a PDP 200 according to a second embodiment of the present invention includes a front panel 120, a rear panel 130, upper discharge electrodes 122, lower discharge electrodes 123, upper barrier ribs 227, lower barrier ribs 137, phosphor layers 139, and a discharge gas. Also, the PDP 200 may further include protective layer 129, address electrodes 133, and a dielectric layer 135.

Since the front panel 120, the upper discharge electrodes 122, the lower discharge electrodes 123, the protective layer 129, the rear panel 130, the address electrodes 133, and the dielectric layer 135, the lower barrier ribs 137 and the phosphor layers 139 are identical to those of the first embodiment, the same reference numerals are used to them and their descriptions will be omitted.

In this embodiment, each of the upper barrier ribs 227 has a first upper barrier rib 227*a* and a second upper barrier rib 227*b*.

The first upper barrier rib 227*a* is arranged between the front panel 120 and the rear panel 130 to partition the discharge cells C. The second upper barrier rib 227*b* is deposited on a lower portion 227*a*' of the first upper barrier rib 227*a*. That is, the first upper barrier rib 227*a* is formed on a lower portion 120' of the front panel such that it is arranged closer to an outside than the second upper barrier rib 227*b*. The second upper barrier rib 227*b* is formed on an upper portion 137" of the lower barrier rib 137 such that it is arranged closer to the phosphor layer 139 than the first upper barrier rib. The first and second upper barrier ribs 227*a* and 227*b* are formed of dielectric materials.

In this case, the first upper barrier rib 227*a* takes on a dark color. Due to it, an external light $V_O$ incident from an outside is absorbed by the first upper barrier rib 227*a* arranged closer to the outside than the second upper barrier rib 227*b*, thereby preventing the light from being reflected to the outside. Consequently, a nominal contrast ratio of the PDP increases.

In addition, the light transmittance of the second upper barrier rib 227*b* is higher than that of the first upper barrier rib 227*a*. Therefore, the visible rays Vi excited at the phosphor layer 139 are reflected without being absorbed by the second upper barrier rib 227*b*. A lot of the visible rays Vi excited at the phosphor layer are emitted to the outside through the front panel 120 such that the brightness of the PDP is improved. In this case, it is preferable that the second upper barrier rib 227*b* takes on a bright color because the bright color tends to reflect the light much more than the dark color.

That is, since the first upper barrier 227*a* arranged closer to the outside does not reflect the external light $V_O$, the nominal contrast ratio of the PDP is improved. Also, since the second upper barrier rib 227*b* arranged closer to the phosphor layer 139 reflects the visible rays Vi, the brightness of the PDP increases, resulting in improving the luminous efficiency.

Here, the bright color means a color having brightness of more than five or a metal color, such as aluminum, having a high light transmittance, and the dark color means color having brightness of less than four in a Munsell color system.

The first upper barrier rib 227*a* may include a dark-colored pigment in dielectric materials whose main component is PbO, $B_2O_3$ or $SiO_2$. That is, the upper barrier rib can easily take on the opaque dark color by adding the dark-colored pigment to the components of the front dielectric layer 25 adopted in the conventional PDP 10.

In this case, the pigment component may be one selected from the group including CdSe, CdS, CoO, $Al_2O_3$, ZnO, $Fe_2O_3$, $Cr_2O_3$, $Cr_2O_3$, $MnO_2$, CuO, and NiO.

Meanwhile, the nominal contrast ratio and the brightness can be optimally improved by adjusting a ratio of a height of the first upper barrier rib 227*a* to a high of the second upper barrier rib 227*b*. That is, the lower surface 227*a*' of the first upper barrier rib 227*a* may be arranged on the upper surface of the upper discharge electrode 122, or between the upper discharge electrode 122 and the lower discharge electrode 123, or on the lower surface of the lower discharge electrode 123.

Specifically, if the upper discharge electrode 122 is arranged within the first upper barrier rib 227*a* and the lower discharge electrode 123 is arranged within the second upper barrier rib 227*b*, both the nominal contrast ratio and the brightness can be appropriately increased at the same time.

Figure 9:
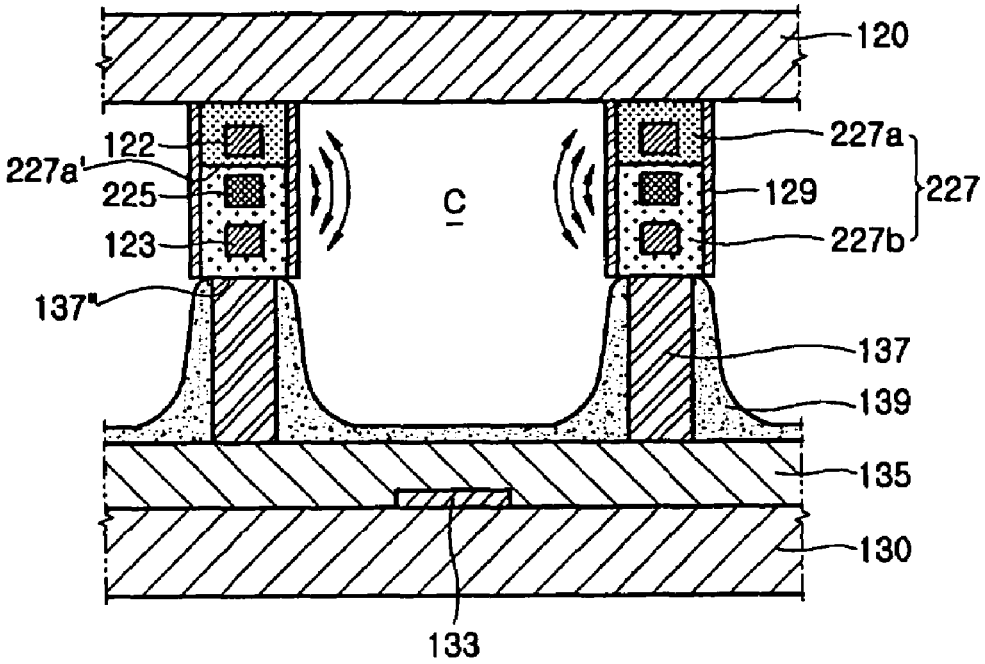
FIG. 9 is a first modification of the PDP shown in FIG. 8.

FIG. 9 is a modification of the PDP shown in FIG. 8. Referring to FIG. 9, the PDP further includes a floating electrode 225. The floating electrode 225 extends in parallel with the upper discharge electrode 122 and the lower discharge electrode 123 therebetween. The floating electrode 225 is not coupled to a separate active voltage source and it is formed of a material having a high electrical conductivity. However, the position of the floating electrode 225 is not limited to it. That is, the floating electrode 225 can be formed at any position enclosing the discharge cells C. Also, although FIG. 9 shows that one floating electrode 225 is arranged, a plurality of floating electrodes 125 can be arranged. Further, although FIG. 9 shows that the floating electrode 225 is formed on the second upper barrier rib 227*b*, the present invention is not limited to it. That is, the floating electrode 225 may be formed on the first upper barrier rib 227*a* or may be formed on both the first and second upper barrier ribs 227*a* and 227*b*.

Figure 10:
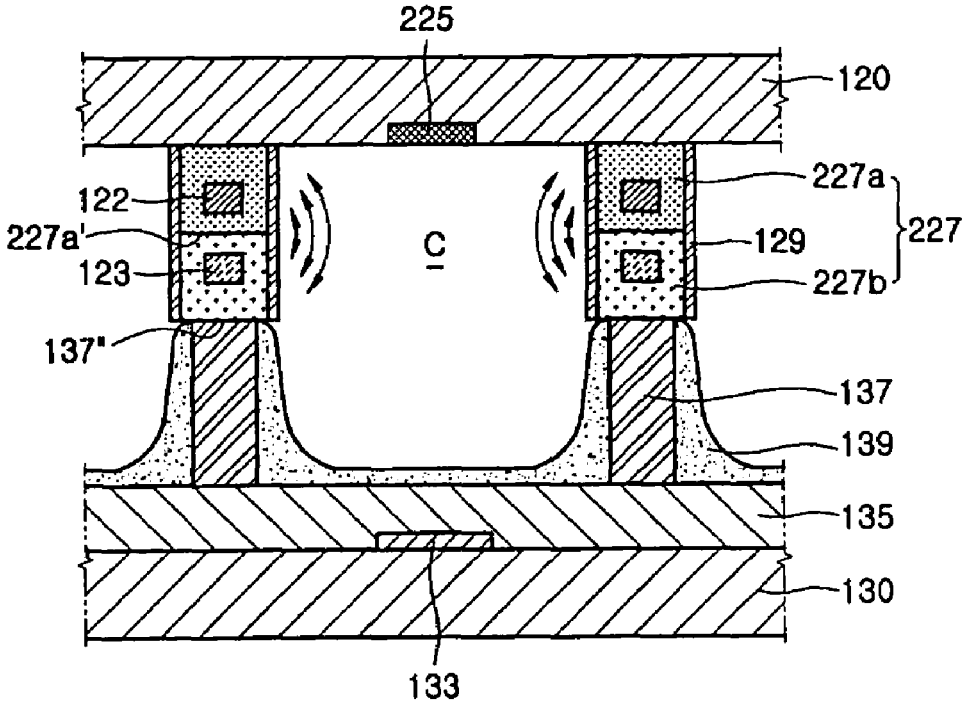
FIG. 10 is a second modification of the PDP shown in FIG. 8.

FIG. 10 is a second modification of FIG. 8. Referring to FIG. 10, a floating electrode 225 is disposed in one direction within a front panel 120. In a PDP 200 having the above construction, discharge is generated even in the front panel 120 as well as in sidewalls of first and second upper barrier ribs 227*a* and 227*b* where upper and lower discharge electrodes 122 and 123 are positioned. As a result, discharge area is extended increasing the discharge efficiency and reducing the discharge voltage. Herein, it is preferable that the floating electrode 225 be made of a transparent electrode material such as ITO since visible rays generated due to a discharge pass through the front panel 120.

As described above, according to the PDP of the present invention, since a front panel has no element thereon, aperture ratio can be remarkably increased and transmittance can be increased from 60% or less corresponding to a transmittance of the conventional PDP to about 90%.

Also, since upper barrier ribs prevent external light from being reflected, bright room contrast is increased and visible rays excited from the phosphor layer are reflected so that brightness and color purity are enhanced, resulting in an increase in light efficiency.

Further, since the structure of the PDP is improved remarkably and the amount of plasma is greatly increased, much visible rays are emitted, brightness is increased, and a low voltage operation is possible, thereby increasing the luminous efficiency.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel comprising:

a transparent front panel;

a rear panel disposed in parallel with said front panel;

a plurality of opaque upper barrier ribs disposed between said front panel and said rear panel to define a plurality of discharge cells, and formed of a dielectric material;

a plurality of lower discharge electrodes and upper discharge electrodes disposed in parallel within said plurality of opaque upper barrier ribs enclosing the discharge cells, at least one of said plurality of lower discharge electrodes and said plurality of upper discharge electrodes respectively including a plurality of separate electrodes;

a plurality of lower barrier ribs disposed between said plurality of opaque upper barrier ribs and said rear panel;

a phosphor layer disposed within a space defined by said plurality of lower barrier ribs;

a discharge gas disposed inside the discharge cells; and a plurality of address electrodes extending to cross said upper discharge electrodes and said lower discharge electrodes;

wherein said upper discharge electrodes and said lower discharge electrodes extend in one direction to be parallel with each other;

wherein a dielectric layer is disposed on said rear panel;

wherein said plurality of address electrodes are disposed between said rear panel and said dielectric layer; and wherein the phosphor layer is disposed on said dielectric layer.

2. The plasma display panel of claim 1, wherein said plurality of opaque upper barrier ribs take on a dark color.

3. The plasma display panel of claim 2, wherein said plurality of opaque upper barrier ribs include a dark-colored pigment.

4. The plasma display panel of claim 3, wherein said pigment includes at least one member selected from the group consisting of CdSe, CdS, CoO, $Al_2O_3$, ZnO, $Fe_2O_3$, $Cr_2O_3$, $MnO_2$, CuO, and NiO.

5. The plasma display panel of claim 1, further comprising at least one floating electrode disposed within said plurality of opaque upper barrier ribs enclosing the discharge cells.

6. The plasma display panel of claim 5, wherein said at least one floating electrode extends in one direction parallel with and between said upper discharge electrodes and said lower discharge electrodes.

7. The plasma display panel of claim 1, further comprising at least one floating electrode extending in one direction within said front panel.

8. The plasma display panel of claim 1, further comprising a passivation layer covering sidewalls of each of said plurality of upper barrier ribs.

9. The plasma display panel of claim 1, wherein each of the upper barrier ribs further comprise:

a first dark upper barrier rib disposed between said front panel and said rear panel to define the discharge cells and formed of a dielectric material; and a second upper barrier rib stacked on lower surface of said first upper barrier rib, formed of a dielectric material, and having a higher light reflectivity than said first dark upper barrier rib.

10. The plasma display panel of claim 9, wherein said first dark upper barrier rib and said second upper barrier rib are formed as a single body separate from said lower barrier ribs and wherein the upper barrier ribs directly contact the lower barrier ribs and the lower barrier ribs contact the rear panel.

11. A plasma display panel comprising:

a transparent front panel;

a rear panel disposed in parallel with said front panel;

a plurality of upper barrier ribs including a plurality of first dark-colored upper barrier ribs disposed between said front panel and said rear panel to define a plurality of discharge cells and formed of a dielectric material, and a plurality of second upper barrier ribs stacked on lower surfaces of said plurality of first upper barrier ribs, formed of a dielectric material, and having a higher light reflectivity than said first upper barrier ribs;

a plurality of lower discharge electrodes and upper discharge electrodes disposed in parallel within said plurality of upper barrier ribs enclosing the discharge cells, at least one of said lower discharge electrodes and said upper discharge electrodes respectively including a plurality of separate electrodes;

a plurality of lower barrier ribs disposed between said plurality of upper barrier ribs and said rear panel;

a phosphor layer disposed on said rear panel within a space defined by said plurality of lower barrier ribs; and a discharge gas disposed inside the discharge cells.

12. The plasma display panel of claim 11, wherein said plurality of second upper barrier ribs take on a bright color.

13. The plasma display panel of claim 11, wherein said plurality of upper ribs include a dark-colored pigment.

14. The plasma display panel of claim 13, wherein said pigment contains at least one member selected from the group consisting of CdSe, CdS, CoO, $Al_2O_3$, ZnO, $Fe_2O_3$, $Cr_2O_3$, $MnO_2$, CuO, and NiO.

15. The plasma display panel of claim 11, further comprising at least one floating electrode disposed within said plurality of upper barrier ribs enclosing the discharge cells.

16. The plasma display panel of claim 15, wherein said at least one floating electrode extends in one direction parallel with and between said upper discharge electrodes and said lower discharge electrodes.

17. The plasma display panel of claim 11, further comprising at least one floating electrode extending in one direction within said front panel.

18. The plasma display panel of claim 17, wherein said floating electrode is transparent.

19. The plasma display panel of claim 11, further comprising a plurality of address electrodes extending to cross said upper discharge electrodes and said lower discharge electrodes.

20. The plasma display panel of claim 19, wherein a dielectric layer is disposed between said rear panel and said phosphor; and wherein said plurality of address electrodes are disposed between said rear panel and said dielectric layer.

21. The plasma display panel of claim 11, further comprising a protective layer covering sidewalls of each of said plurality of upper barrier ribs.

22. The plasma display panel of claim 11, wherein one of said upper discharge electrodes is disposed within one of said plurality of first upper barrier ribs and one of said lower discharge electrodes is disposed within one of said plurality of second upper barrier ribs.

23. The plasma display panel of claim 11, wherein the dark color being a color having brightness of less than four in a Munsell color system.

* * * * *